US006269573B1

(12) United States Patent
Najmi

(10) Patent No.: US 6,269,573 B1
(45) Date of Patent: Aug. 7, 2001

(54) INFORMATION TAG

(75) Inventor: Boman K Najmi, Crofton, MD (US)

(73) Assignee: BHS International, Inc., Crofton, MD (US)

( * ) Notice: Subject to any disclaimer, the term of this patent is extended or adjusted under 35 U.S.C. 154(b) by 0 days.

(21) Appl. No.: 09/563,907

(22) Filed: May 4, 2000

(51) Int. Cl.[7] ..... G09F 3/16
(52) U.S. Cl. ..... 40/666; 40/658; 248/222.12
(58) Field of Search ..... 40/666, 607, 658; 248/74.1, 74.2, 74.3, 222.11, 222.12, 222.13

(56) References Cited

U.S. PATENT DOCUMENTS 2,616,196 * 11/1952 Sandahl, Jr. et al. ..... 40/607
4,505,006 * 3/1985 Andre ..... 248/74.3
4,817,897 * 4/1989 Kreusel ..... 248/74.1
5,479,735 * 1/1996 Martin, Jr. ..... 40/607
5,845,883 * 12/1998 Meyer ..... 248/74.1

* cited by examiner

*Primary Examiner*—Cassandra Davis
(74) *Attorney, Agent, or Firm*—Rabin & Champagne, P.C.

(57) ABSTRACT

An information tag (100) for use on a elongate object (200), which tag (100) comprises a tag body (10) having a surface (11/12) for displaying information and a ring (16), and a separate clamp (20) for connecting the tag body (10) to the object (200). The clamp (20) is openable to present two ends (22A) and subsequently closable for connection to the object (200), with the two ends (22A) being restricted close together by the ring (16) of the tag body (10).

8 Claims, 4 Drawing Sheets

INFORMATION TAG

BACKGROUND OF THE INVENTION

Information tags in general are known for displaying information of any kind. In one type, the information tag has a body that is provided with a strap for connection to a support or product. The strap may not be convenient to use or provide a sufficiently stable connection, and is often too long, leaving a tail behind in use.

The invention seeks to mitigate or to at least alleviate such problems by providing an improved information tag.

SUMMARY OF THE INVENTION

According to the invention, there is provided an information tag for use on a elongate object, which tag comprises a tag body having a surface for displaying information and an engagement part, and a separate clamp for connecting the tag body to said object, which clamp is openable to present two ends and subsequently closable for connection to said object, with said two ends being restricted close together by the engagement part of the tag body.

Preferably, the clamp is substantially cylindrical when it is closed, and is split on one side as between its two ends.

Preferably, the clamp comprises two parts having respective said ends.

More preferably, the two clamp parts are integral with each other, and a weakened fold line is formed between them.

In a preferred construction, the two clamp ends together form a protrusion on one side of the clamp when the clamp is closed.

More preferably, the protrusion has a conical head and a neck connecting the head to the clamp.

Conveniently, the engagement part is an integral part of the tag body.

In a preferred embodiment, the engagement part comprises a hole for restricting the two clamp ends close together by surrounding them, as a result of the engagement part and the clamp ends being push-fitted together.

More preferably, the engagement part is in the form of a ring.

Further more preferably, the protrusion has a conical head and a neck connecting the head to the clamp, and a notch is formed in the tag body immediately behind the ring for accommodating the head of the protrusion while the ring surrounds the neck.

It is preferred that either one of the engagement part and the two clamp ends together has a substantially circular cross-section, such that when they are inter-engaged the tag body is rotatable relative to the clamp over 360°.

Advantageously, the clamp is provided, on its inner side, with at least one resilient member for gripping said object.

BRIEF DESCRIPTION OF DRAWINGS

The invention will now be more particularly described, by way of example only, with reference to the accompanying drawings, in which.

DETAILED DESCRIPTION OF PREFERRED EMBODIMENT

Figure 1:
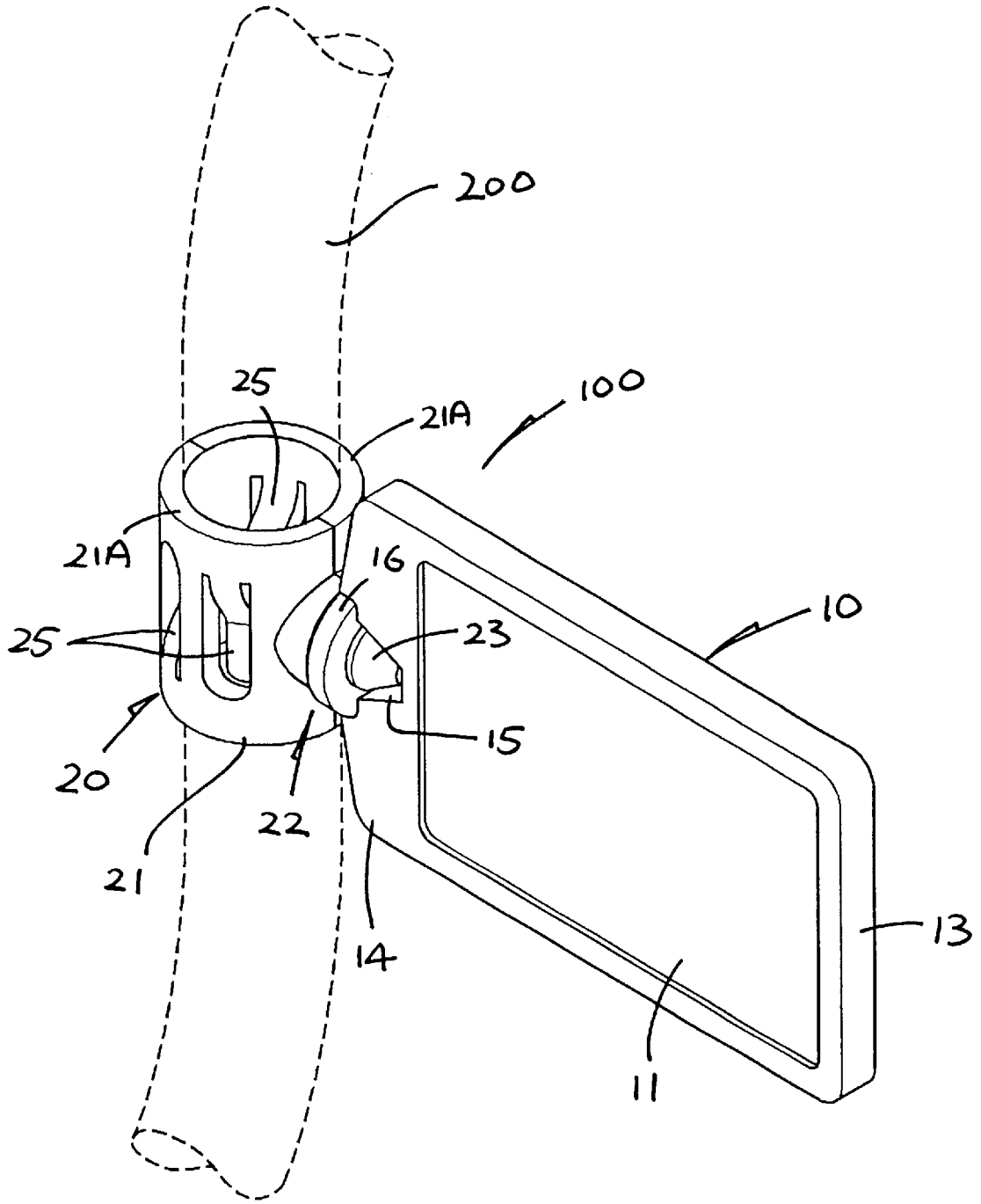
FIG. 1 is a perspective view of an embodiment of an information tag in accordance with the invention, which has a tag body and a clamp.
Figure 2:
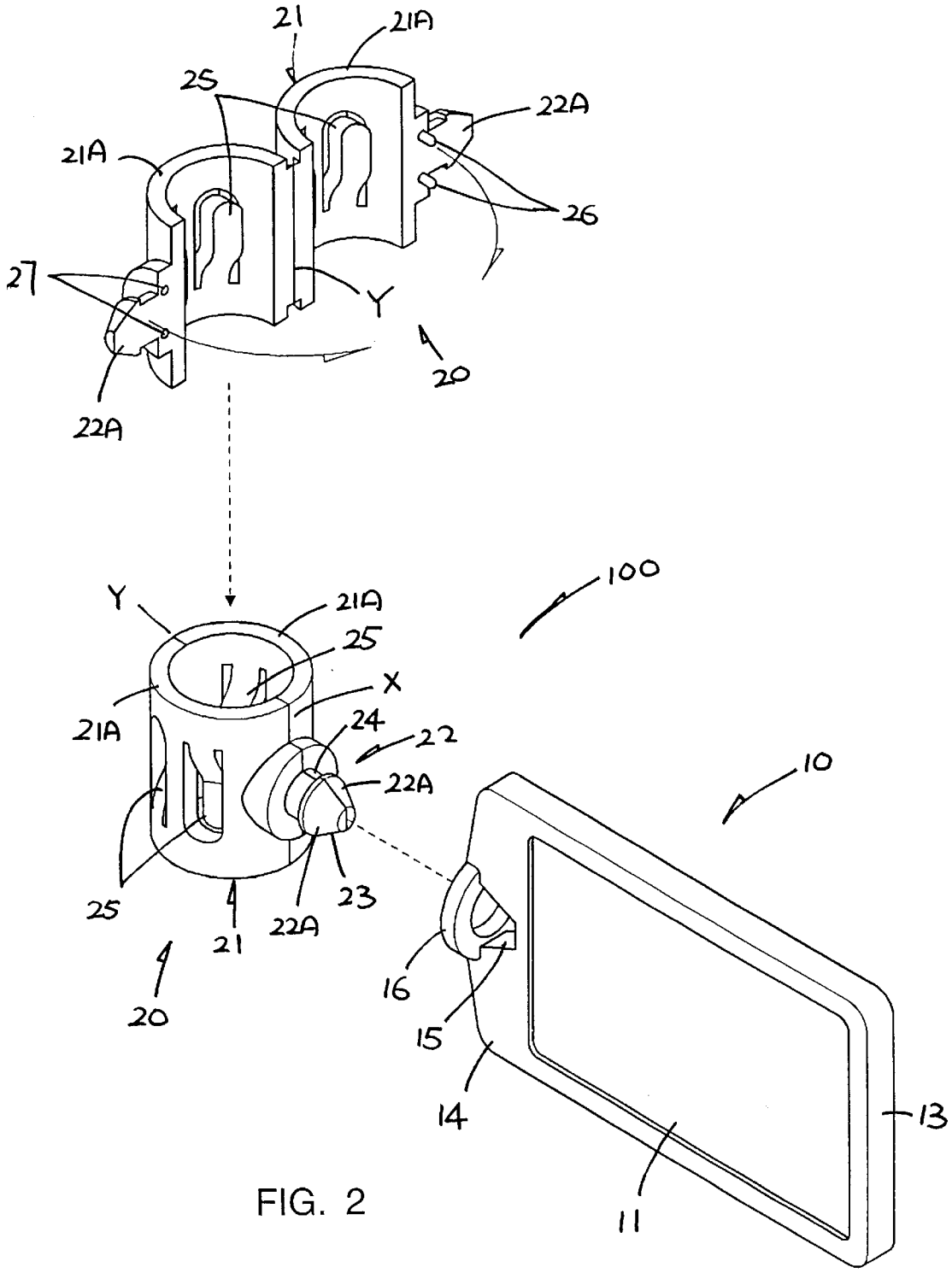
FIG. 2 is a perspective view corresponding to FIG. 1, showing how the clamp works and the tag body is connected to the clamp.
Figure 3:
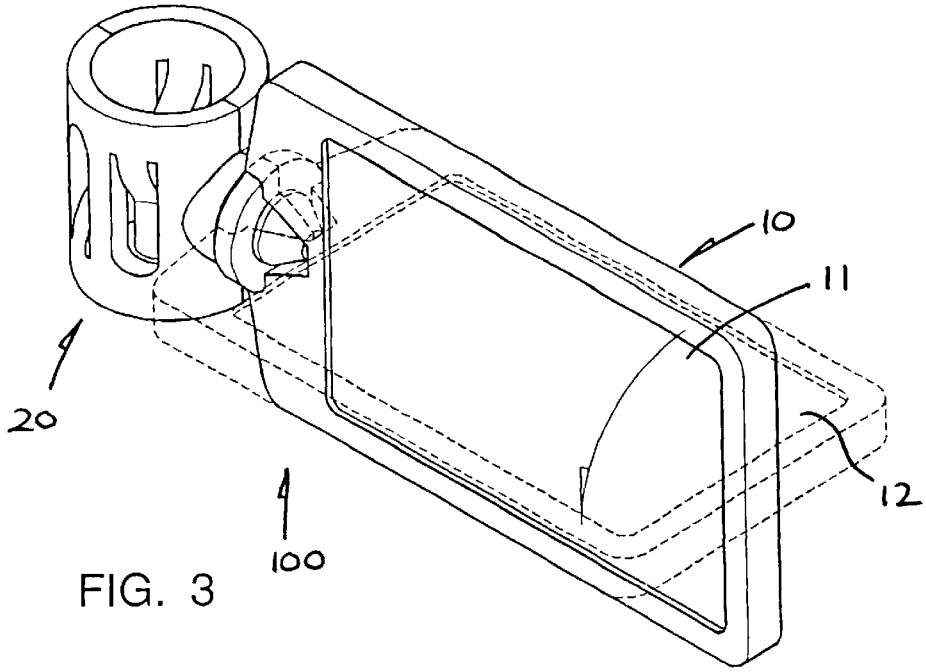
FIG. 3 is a perspective view corresponding to FIG. 1, showing the tag body being rotatable relative to the clamp.
Figure 4:
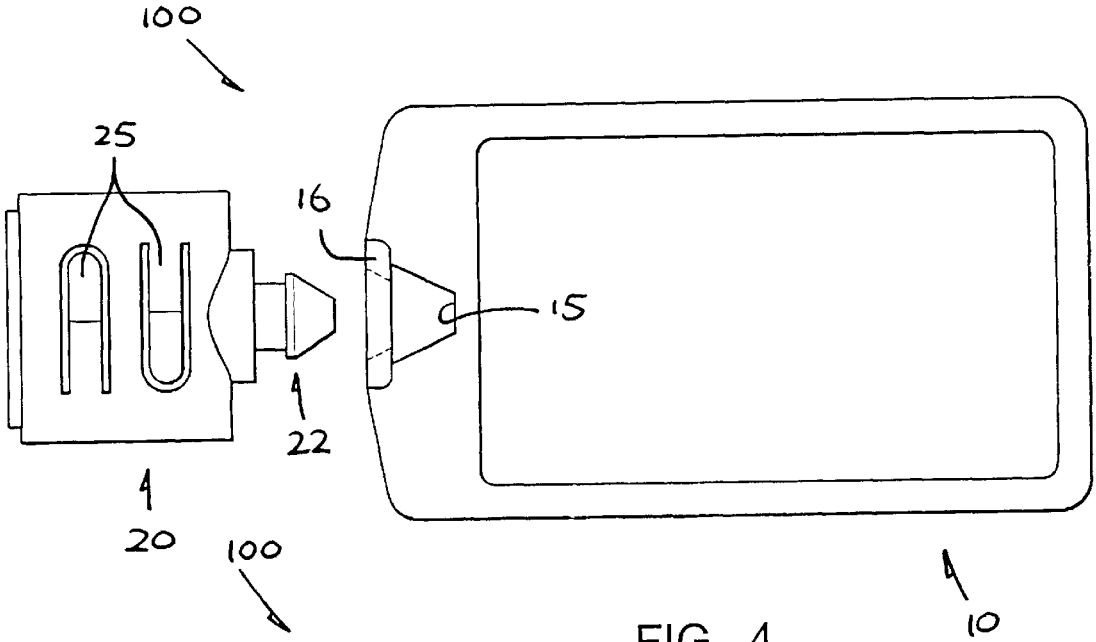
FIGS. 4 and 5 are side and top plan views of the information tag of FIG. 1, showing the tag body and clamp separated.
Figure 5:
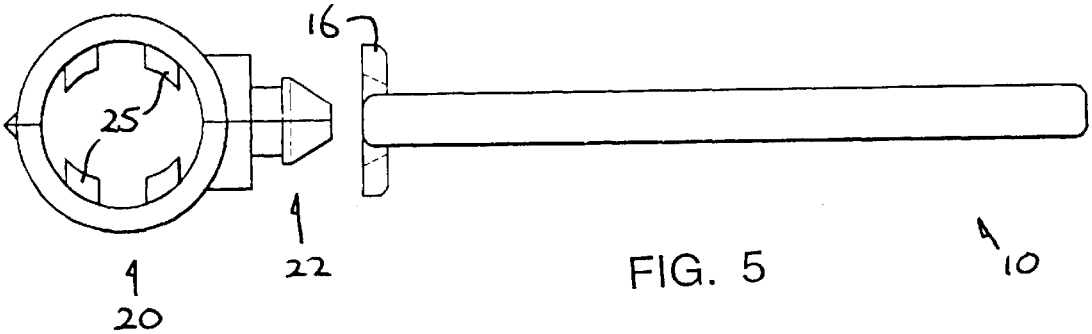
Figure 6:
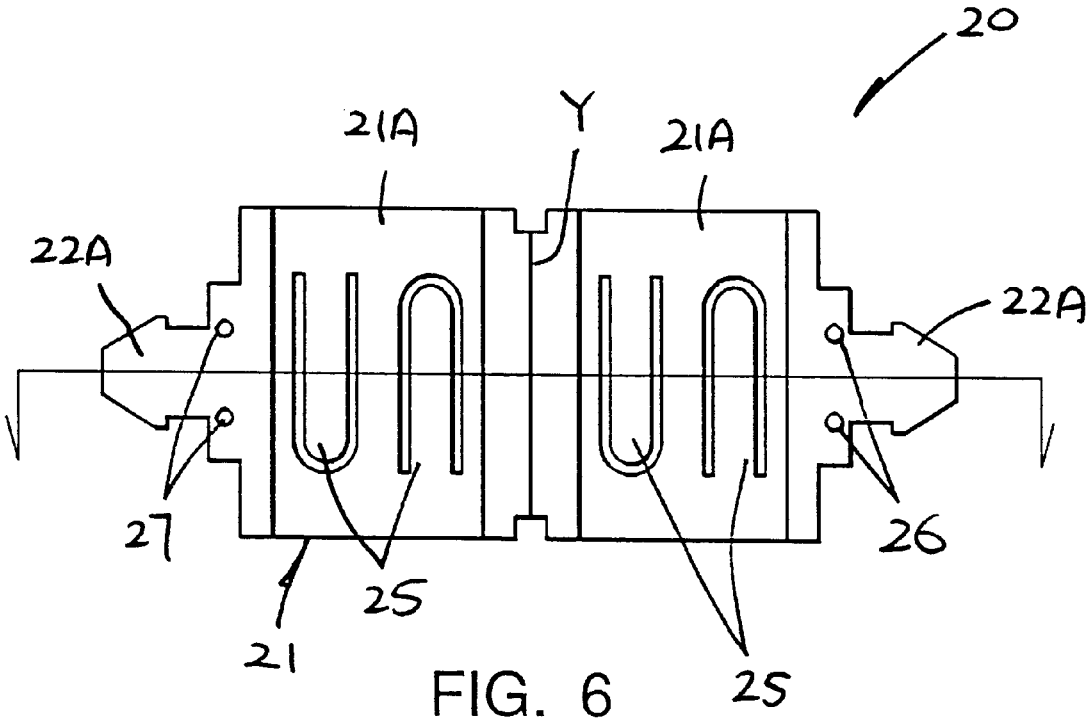
FIGS. 6 and 7 are side and cross-sectional top plan views of the clamp of FIG. 1, in an open condition.
Figure 7:
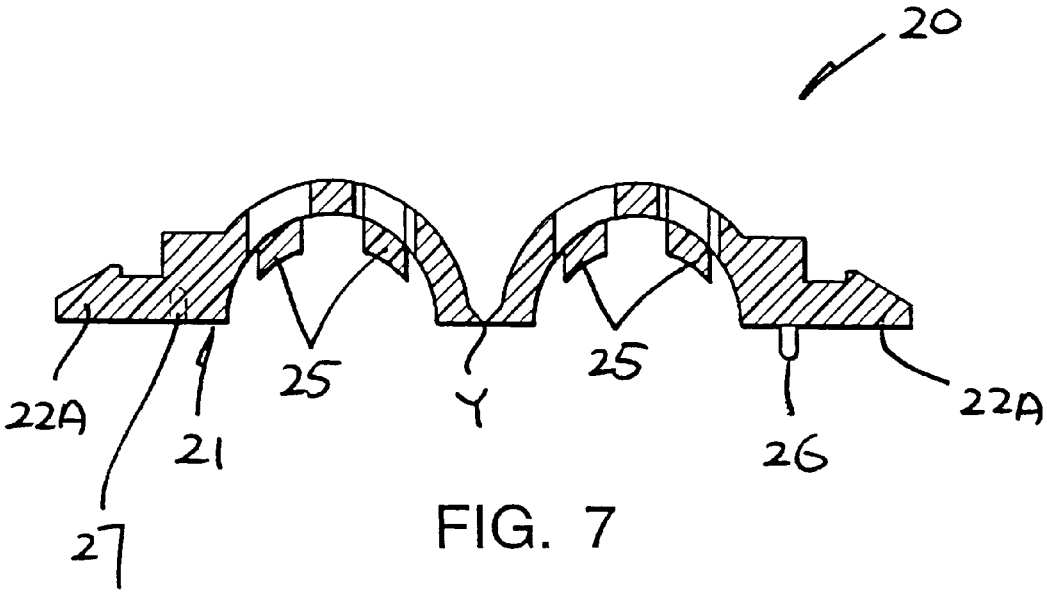

Referring to the drawings, there is shown an information tag 100 embodying the invention, which tag 100 comprises a plastics tag body 10 and a separate plastics clamp 20 connected to the tag body 10 for attachment onto a elongate object, such as a cord 200 of a stethoscope.

The tag body 10 is flat rectangular in shape, having opposite sides 11 and 12 for displaying information and including front and rear ends 13 and 14. The rear end 14 is formed with a notch 15 and a circular ring 16 integrally across the open end of the notch 15. More specifically, the notch 15 generally extends along the principal axis of the tag body 10 and the ring 16 lies in an imaginary plane perpendicular to that axis. The hole as provided by the ring 16 has a diameter relatively smaller than the width of the notch 15 at its open end.

The clamp 20 has a cylindrical body 21, on one side X of which an integral stud 22 projects radially outwards. The stud 22 has a conical head 23 and a neck 24 connecting the head 23 to the clamp body 21. The head 23 has an outer diameter slightly larger than the inner diameter of the ring 16, such that the stud 22 (or its head 23) may be push-fitted through the ring 16 or alternatively the ring 16 may be pushed to fit around the stud 22 (or its neck 24), whereby the tag body 10 and clamp 20 are connected together. The notch 15, which is provided immediately behind the ring 16, serves to accommodate the head 23 while the ring 16 surrounds the neck 24.

The clamp body 21 is slit open longitudinally on the side X, for opening into two halves or parts 21A that remain inter-connected along a weakened fold line Y formed on the diametrically opposite side. The splitting plane coincides with the axis of the stud 22, such that each body part 21A carries a corresponding half 22A of the stud 22 at its end. The two body parts 21A are foldable, about the fold line Y, to open apart and close together, thereby enabling the clamp 20 to clamp onto the cord 200. While the clamp 20 is in the closed condition (on the cord 200), in which the two stud halves 22A are brought back together, the tag body 10 may be connected to the clamp 20 for use, through push-fit engagement between the ring 16 and the stud 22 as described above.

During use, the tag body 10 holds the clamp 20 closed by reason of the ring 16 restricting the two stud parts 22A close together by surrounding them. As both the inner side of the ring 16 and the neck 24 of the stud halves 22A together have a circular cross-section, the tag body 10 is rotatable relative to the clamp 20 over 360° to any angle or to reveal either side 11/12 for viewing.

The wall of each body part 21A is integrally formed with a pair of longitudinally extending fingers 25 which are displaced inwardly as well as resilient for gripping the cord 200 and/or suiting cords of slightly different diameters. Optionally, two pairs of inter-engageable pins 25 and holes 26 are formed on the split surfaces of the body parts 21A respectively, for engagement to reinforce the clamp 20 when the clamp 20 is in the closed condition in use.

The invention has been given by way of example only, and various modifications of and/or alterations to the described embodiment may be made by persons skilled in the art without departing from the scope of the invention as specified in the appended claims.

What is claimed is:

1. An information tag for use on a elongate object, which tag comprises:

a tag body having a surface for displaying information and an engagement part; and a separate clamp for connecting the tag body to the object, the clamp being openable to present two ends and subsequently closable for connection to the object, with said two ends being restricted close together by the engagement part of the tag body, wherein the engagement part comprises a ring having a hole for restricting the two clamp ends close together by surrounding them, as a result of the engagement part and the clamp ends being push-fitted together, wherein the two ends form a protrusion having a conical head and a neck connecting the head to the clamp, and wherein a notch is formed in the tag body immediately behind the ring for accommodating the head of the protrusion while the ring surrounds the neck.

2. The information tag as claimed in claim 1, wherein the clamp is substantially cylindrical when it is closed, and is split on one side between its two ends.

3. The information tag as claimed in claim 1, wherein the clamp comprises two parts, each part having a respective one of said ends.

4. The information tag as claimed in claim 3, wherein the two clamp parts are integral with each other, and a weakened fold line is formed between them.

5. The information tag as claimed in claim 1, wherein the two clamp ends together form the protrusion on one side of the clamp when the clamp is closed.

6. The information tag as claimed in claim 1, wherein the engagement part is an integral part of the tag body.

7. The information tag as claimed in claim 1, wherein either one of the engagement part and the two clamp ends together has a substantially circular cross-section, such that when they are inter-engaged, the tag body is rotatable relative to the clamp over 360°.

8. The information tag as claimed in claim 1, wherein the clamp is provided, on its inner side, with at least one resilient member for gripping the object.

* * * * *